US009587922B2

(12) United States Patent
Kalifa et al.

(10) Patent No.: US 9,587,922 B2
(45) Date of Patent: Mar. 7, 2017

(54) ATTACK CAPABILITY ENHANCING BALLISTIC SABOT

(71) Applicant: Raytheon Company, Waltham, MA (US)

(72) Inventors: Michael G. Kalifa, Waltham, MA (US); Zachary Williamson, Waltham, MA (US)

(73) Assignee: Raytheon Company, Waltham, MA (US)

( * ) Notice: Subject to any disclaimer, the term of this patent is extended or adjusted under 35 U.S.C. 154(b) by 432 days.

(21) Appl. No.: 13/861,684

(22) Filed: Apr. 12, 2013

(65) Prior Publication Data

US 2016/0102953 A1 Apr. 14, 2016

(51) Int. Cl.

| | |
|---|---|
| ***F42B 14/06*** | (2006.01) |
| *F42B 10/14* | (2006.01) |
| *F42B 10/64* | (2006.01) |

(52) U.S. Cl.

CPC ..... *F42B 14/064* (2013.01); *F42B 10/14* (2013.01); *F42B 10/64* (2013.01)

(58) Field of Classification Search

CPC ..... F42B 14/08; F42B 14/064; F42B 14/065; F42B 14/067; F42B 12/34; F42B 12/36

USPC ..... 102/211, 213, 214, 520

See application file for complete search history.

(56) References Cited

U.S. PATENT DOCUMENTS

| | | | | |
|---|---|---|---|---|
| 4,142,467 | A | 3/1979 | Stahlmann et al. | |
| 4,430,942 | A * | 2/1984 | Heyman | F42B 14/06 102/520 |
| 4,754,706 | A * | 7/1988 | Fauvel | F42B 12/62 102/489 |
| 5,003,886 | A * | 4/1991 | Pahnke et al. | 102/521 |
| 5,388,524 | A * | 2/1995 | Strandli et al. | 102/529 |
| 5,493,974 | A * | 2/1996 | Bilgeri | 102/522 |
| 5,679,919 | A * | 10/1997 | Holm et al. | 102/377 |
| 8,439,301 | B1 * | 5/2013 | Lussier | B64F 1/02 244/63 |
| 2003/0110973 | A1 * | 6/2003 | Mutascio | F42B 12/46 102/477 |
| 2004/0139877 | A1 * | 7/2004 | Ronn | F42B 12/58 102/489 |
| 2011/0101097 | A1 * | 5/2011 | Olden et al. | 235/404 |

FOREIGN PATENT DOCUMENTS

GB 2195749 * 4/1988

OTHER PUBLICATIONS

ATK Orbital, "Im Hellfire Rocket Motor", Fact Sheet, Oct. 2010, pp. 2, Orbital ATK Defense Systems Group, Rocket Center, WV.

(Continued)

*Primary Examiner* — Stephen M Johnson

(57) ABSTRACT

A ballistic sabot for adapting a payload to a launch device is disclosed. The ballistic sabot can include a support structure configured to be releasably coupled to a payload and to operably interface with a launch device. The launch device can be operable to launch the payload and the support structure on a ballistic trajectory. The support structure can be configured to retain and travel with the payload along the ballistic trajectory substantially beyond the launch device prior to release and separation from the payload.

16 Claims, 12 Drawing Sheets

(56) References Cited

OTHER PUBLICATIONS

ATK Orbital, "XM395", Fact Sheet, Nov. 2009, pp. 2, Orbital ATK Armament Systems, Plymouth, MN.
ATK, "PGK-Precision Guidance Kit", http.://wwworbitalatk.com/defense-systems/armament-systems/pgk/PCK_Fact_Sheet.pdf, 2013, pp. 2, Orbital ATK.
Defense Industry Daily Staff, "Cheap, Fast, Deadly: Netfires 'Missiles in a Box' (NLOS-LS)", http://www.defenseindustrydaily.com/cheap-fast-deadly-the-netfires-missiles-in-a-box-program-updated-02653/, Jan. 2011, pp. 8, Defense Industry Daily LLC.
Defense Industry Daily Staff, "US Army Wants 120mm Guided Mortars for the Front Lines (APMI/X,M395)", http://www.defenseindustrydaily.com, Feb. 6th, 2011, pp. 4.
Defense Update, "Excalibur XM982" http://www.defense-update.com/products/e/excalibur.htm, Jul. 2006, pp. 2.
Defense Update, "Raytheon, IMI Turn Dumb Mortar Bombs into Precision Weapons", http://defense-update.com/products/d/dagger_040709.html, 2009, pp. 1, Online Holdings International.
Eshel, "Oto Melara Introduces a 76mm Version of Vulcano Multi-Mission, Long Range Naval Projectile Technology", Defense Update, Sep. 28, 2011, pp. 5, Europe.
Fischer et al, "Italy 127mm/64(5")LW", www.navweaps.com/Weapons/WNIT_5-64_LW.htm, Apr. 17, 2008, pp. 7, Italy.
Pike, "M395 Precision-Guided Mortar Munition (PGMM)", http://www.globalsecurity.org/military/systems/munitions/pgmm.htm, Jul. 2011, pp. 5, Global Security.
Trimble, "AUVSI: Mini-Munititons Get Big for Small UAS", Press release, Aug. 5th , 2011, pp. 4, Raytheon, Washington DC.
Uberuaga, "TALON Laser-Guided Rocket Team Completes First Guided Test Flights", PRN Newswire, Sep. 2011, pp. 2, Raytheon Company.
Pike et al, "FIM-92A Stinger Weapon System: RMP & Basic", FAS Military Analysis Network, Aug. 2000, pp. 5.
Turner, "Munitions Executive Summit", Combat Ammunition Systems, Feb. 2012, pp. 8.
Wade et al, "Trench Mortars and Ammunition", Handbook of Ordnance Data, Nov. 1918, pp. 230-235, Government Printing Office, Washington.
Wood, "Precision Extended Range Munitions to Improve Capabilities of US Marine Corps Expeditionary Forces", PRNewswire, Jan. 2013, pp. 2, Raytheon Company, Tucson, AZ.
US Army, "Guided Multiple Launch Rocket System (GMLRS) DPICM/Unitaly/Alternative Warhead (Tactical Rockets)", http://fas.org/man/dod-101/sys/land/wsh2012/124.pdf, 2012, pp. 2, United States.
American Ordnance, "M929/M933/M934", http://www.aollc.biz/pdf/120mmmortarm929-m933-m934.pdf, 2008, pp. 1, American Ordnance LLC, Iowa.

* cited by examiner

ATTACK CAPABILITY ENHANCING BALLISTIC SABOT

BACKGROUND

Launch devices, such as guns or mortars, are prevalent among artillery forces. Typically, such launch devices fire unguided projectiles that follow a ballistic trajectory to a target. In some battlefield situations it is desirable to launch a guided munition at a target. One solution achieving this is to convert a mortar body into a precision mortar round by replacing a standard fuse in the mortar fuse well with a guidance kit that includes fins, a guidance system, and a fuse. Once fired, the fins can provide guidance for the mortar and the guidance system can direct the mortar to a target.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
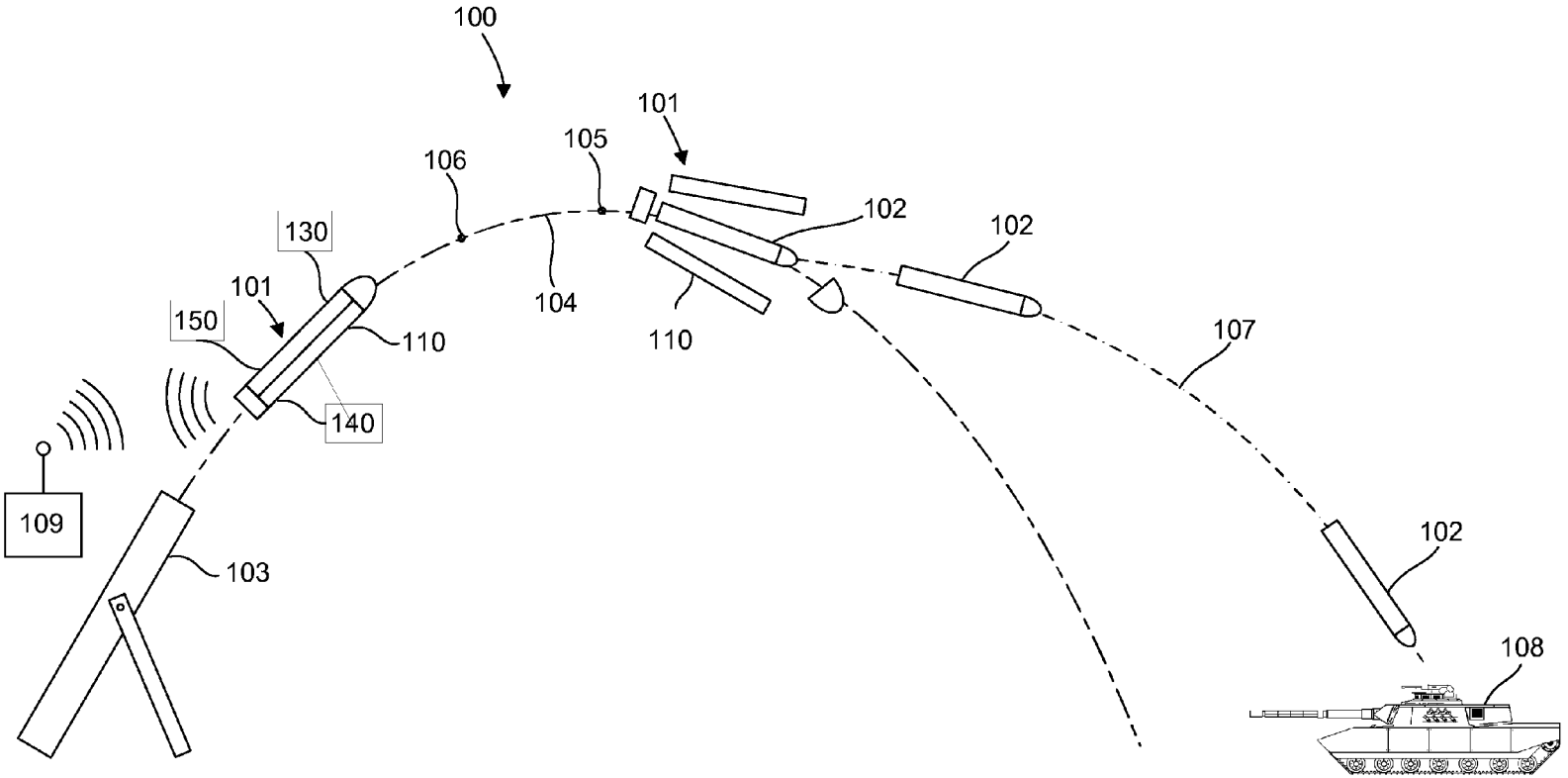
FIG. 1 is an example illustration of a payload delivery system in accordance with an embodiment of the present invention.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

Although a guided mortar is serviceable for some applications, it is a single mortar projectile in a traditional mortar form factor that is gun hardened or g-hardened to withstand the high g-loads experienced upon firing. Thus, the mission capabilities of the guided mortar are limited to those available from the gun-hardened guided mortar munition, which may be severely lacking in its capabilities for being used for a given mission objective.

Accordingly, a ballistic sabot for adapting a payload to a launch device is disclosed that adapts a non g-hardened payload, or a partially g-hardened payload, for use with a launch device that launches projectiles with high-g loading, as well as that enhances the attack capability of the projectiles or payload by having at least a portion of the ballistic sabot remain with the payload at least partially during flight. This can expand the capabilities available to accomplish a wide variety of mission objectives. In one example, the range of the non or partially g-hardened payload can also be increased using the ballistic sabot. The ballistic sabot can include a support structure configured to be releasably coupled to a payload and to operably interface with a launch device. The launch device can be operable to launch the payload and the support structure on a ballistic trajectory. The support structure can be configured to retain and travel with the payload along the ballistic trajectory substantially beyond the launch device prior to release and separation from the payload.

In another aspect, a payload delivery system is disclosed. The system can comprise a launch device, a payload, and a ballistic sabot for adapting the payload to the launch device, wherein a support structure of the ballistic sabot is configured to remain with the payload after launch and to be caused to separate from the payload at or near apogee. The ballistic sabot can have a support structure configured to be releasably coupled to the payload and to operably interface with the launch device. The launch device can be operable to launch the payload and the support structure on a ballistic trajectory. The support structure can be configured to remain and travel with the payload along the ballistic trajectory substantially beyond the launch device prior to release and separation from the payload.

One embodiment of a payload delivery system 100 is illustrated in FIG. 1. The payload delivery system 100 can comprise a ballistic sabot 101, a payload 102, and a launch device 103. The ballistic sabot 101 can have a support structure 110 configured to be releasably coupled to the payload 102 and to operably interface with the launch device 103. The launch device 103 can be operable to launch the payload 102 and the ballistic sabot 101 on a ballistic trajectory 104. The support structure 110 of the ballistic sabot 101 can be configured to retain and travel with the payload 102 along the ballistic trajectory 104 substantially beyond the launch device 103 prior to release and separation from the payload 102, which can facilitate greater range for the payload 102, as described hereinafter. For this and other reasons described herein, the ballistic sabot 101 does not merely permit the firing of sub-caliber ammunition out of a larger caliber tube, as with a typical sabot.

The launch device 103 can comprise a mortar, a gun, a cannon, a rail gun, or any other suitable device or platform for launching the ballistic sabot 101 and the payload 102. In particular examples, the launch device 103 can be a five inch naval gun, six inch naval gun, 120 mm mortar, 105 mm tank gun, 120 mm tank gun, 155 mm howitzer, 81 mm mortar, or 105 mm howitzer. However, these are not meant to be limiting in any way as those skilled in the art will recognize. The attributes of a ballistic sabot disclosed herein can therefore be scalable to function with different launch devices.

Typically, the launch device 103 provides an initial high "g" or gun shock to a munition in order to launch the munition on a ballistic trajectory. The payload 102, on the other hand, may not be "g-hardened" or insufficiently "g-hardened" and therefore, would typically be unavailable for launch from the launch device 103 without modification to the payload 102 and/or the launch device 103. Not intending to be limiting in any way, the payload 102 can comprise, for example, a laser guided rocket (LGR), a small tactical munition (STM), a missile (i.e., a Stinger or Dart missile), or any other suitable payload, weapon, or munition, such as a lethal or non-lethal munition. In some embodiments, the payload 102 can include GPS and/or laser guided systems. In other embodiments, the payload 102 can be a self-propelled weapon system and can include, for example, a rocket motor or thruster. As described herein, the ballistic sabot 101 can adapt the payload 102 to the launch device 103 and enable firing or launching of a non g-hardened or partially g-hardened payload 102 from the launch device 103, without modification of either the payload 102 or the launch device 103. The ballistic sabot 101 can therefore be compatible with an existing fire control system on the launch device 103.

In one aspect, the launch device 103 can have a smooth bore or a rifled bore. A rifled bore can impart spin on the ballistic sabot 101 for a payload 102 that requires spin up. If spin up of the payload 102 is not desired, an outer portion of the ballistic sabot 101 can be caused to spin as a result of the rifling, with the ballistic sabot 101 configured to substantially isolate the payload 102 from the spinning outer portion, such as with a spin slip ring.

The ballistic sabot 101 can have any suitable size, shape, and/or profile. In one aspect, the ballistic sabot 101 can have a size, shape, and/or profile such that the ballistic performance of the sabot 101 with the payload 102 mimics that of standard ammunition for the particular launch device 103 or gun system, until the payload 102 is released. Thus, the ballistic sabot 101 can be an integral part of the ballistic mass, along with the payload 102, and can be retained to apogee 105 of the ballistic trajectory 104, or beyond, if desired. This can facilitate greater range for the payload 102 and/or a shorter time to target than an unpowered traditional launch device munition when the payload is self-propelled. In one aspect, the ballistic sabot 101 can facilitate a flatter angle of attack than would otherwise be possible.

The ballistic sabot 101 can be discarded as it approaches apogee 105, such as at point 106, which is well clear of the launch device 103, to minimize overhead safety issues. Once the payload 102 has separated from the ballistic sabot 101, the payload 102 can assume its normal operational mode, such as by maneuvering on a path 107 to a target 108. In one aspect, the support structure 110 of the ballistic sabot 101 can be configured to retain and travel with the payload to the apogee 105 of the ballistic trajectory 105 prior to release and separation from the payload 102. In another aspect, the support structure 110 of the ballistic sabot 101 can be configured to retain and travel with the payload 102 beyond the apogee 105 of the ballistic trajectory 104, as shown in the figure, prior to release and separation from the payload 102.

In one aspect, the ballistic sabot 101 can separate from the payload once enough energy has been dissipated that the payload 102 can survive conditions without the protection of the ballistic sabot 101. In one example, maximum ablative speed can be the maximum speed that a sensor dome or other component of the payload 102 can tolerate due to atmospheric heating. In another example, maximum ablative speed can be the maximum speed that the payload 102 can tolerate due to aerodynamic structural loads.

In one aspect, the support structure 110 of the ballistic sabot 101 can be configured to "disintegrate" or disassemble at or just past apogee 105 to release the payload 102. For example, the ballistic sabot 101 can include a release mechanism 130, such as a "zero g" or gravity actuated release mechanism, that actuates or that is triggered at or near apogee 105 when the vertical kinetic energy of the launch has been depleted (i.e., substantially no vertical kinetic energy) to facilitate disintegration or disassembly of the ballistic sabot structure 110, which can facilitate release of the payload 102. Thus, in one aspect, the ballistic sabot 101 may not require energetics for any post launch separation functionality, as gravitational force can be operable to release the ballistic sabot 101 from the payload 102.

In another aspect, however, energetics, such as a pyrotechnic charge, can be utilized to trigger separation of the ballistic sabot 101 from the payload 102. It is noted herein that the ballistic sabot 101 can be configured to remain intact about the payload 102 and continue in flight with the payload following launch. That is, unlike typical sabots that separate from the payload in response to the shock of encountering still air shortly after launch (i.e., just after the sabot and projective exit the launch device), the ballistic sabots discussed herein can be configured to remain intact and with the ballistic sabot until actively caused to separate from the payload(s) due to a triggering event, thus permitting the payload and the ballistic sabot to continue in flight until such separation is triggered.

In one aspect, at or after apogee 105, the ballistic sabot 101 and the payload 102 can nose over under the influence of gravity to point in the general direction of the target 108. The payload 102 can be configured to maneuver to the target 108 upon separation from the ballistic sabot 101. Releasing the payload 102 near apogee 105 can significantly extend the range of the deployed payload 102. For example, aero analyses have shown a possible range increase of ~300%. This can enable targeting an object that would otherwise be out of range for the launch device 103 using standard munitions and/or the range of the payload 102 without use of the ballistic sabot 101. The ballistic sabot 101 can therefore facilitate leveraging of existing munitions or payloads and could potentially eliminate the need to develop unique projectiles for each mission, resulting in a launch device 103 with capabilities that were previously unaffordable.

The ballistic sabot 101 can also include an electronic module 140 configured to communicate with the payload 102, such as by an electrical, optical, wireless connection, or any other suitable communication connection. The electronics module 140 can include GPS and/or RF communication devices for mission updates, such as re-targeting, or mission reporting. Thus, in one aspect, the electronic module 140 can also be configured to communicate with a command station 109 separate or remote from the ballistic sabot 101 and the payload 102. In this case, the electronic module 140 can be configured to relay communication between the command station 109 and the payload 102, such as in-flight position or data GPS data, target cueing data, and/or target tracking data. This can include, but is not limited to, a target 108 and/or payload 102 GPS position update, and/or RF, IR, or LASER cueing signals. The ballistic sabot 101 can therefore facilitate communication between the payload 102 and the command station 109 or other source of guidance information for the payload 102. Such communication can occur prior to, or after, release and separation of the payload 102 from the ballistic sabot 101.

In some aspects, the electronic module 140 can facilitate setting of the payload 102 while contained within the ballistic sabot 101, electrically initiate and/or power up the payload 102, perform a built in test (BIT) of the payload 102, send a rocket motor ignition and/or arming signal to the payload 102, transmit payload status back to the command station 109, and/or provide in-flight retargeting capability for the payload 102. Inductive setting, for example, can be accomplished by a reciprocal inductive coil hardwired to the payload 102. In addition, just prior to or upon release of the payload 102, the electronics module 140 can send a rocket motor firing or ignition signal to the payload 102. In one aspect, this signal can be initiated by the release mechanism 130. The electronic module 140 can also include a sensor to sense a proper payload dispersal environment based on parameters set prior to launch or received via communications with the command station 109 after launch. In one aspect, the electronic module 140 can include gun hardened circuit card assemblies (CCA) in order to ensure proper function of the electronic module 140 during use.

In one aspect, the target cue can be acquired independently by the payload 102, such as using IR and/or UV targeting devices. In another aspect, the target 108 can be designated by a target observer, such as with a laser designator. In yet another aspect, the payload can be guided to the target 108 by GPS or inertial navigation with or without an in-flight update from the ballistic sabot 101 and/or the command station 109.

The ballistic sabot 101 can also include a launch force attenuation device 150 configured to absorb launch forces to protect the payload 102 from damage. For example, the launch force attenuation device 150 can be configured to attenuate sufficient shock and vibration to facilitate launch of a non or partially g-hardened payload 102 from a launch device 103 that typically launches g-hardened munitions. In one aspect, the launch force attenuation device 150 can be configured to attenuate a percentage of set-back, set-forward, and/or balloting induced g-loading on the payload 102. For example, as discussed in more detail hereinafter, the launch force attenuation device 150 can utilize hydraulic, pneumatic, spring, crush plate, screw, magnetic, or other devices in any combination in order to create an environment in which a non or partially g-hardened payload 102 can remain viable while being launched at g loads that exceed the design limits of the payload 102.

Figure 2:
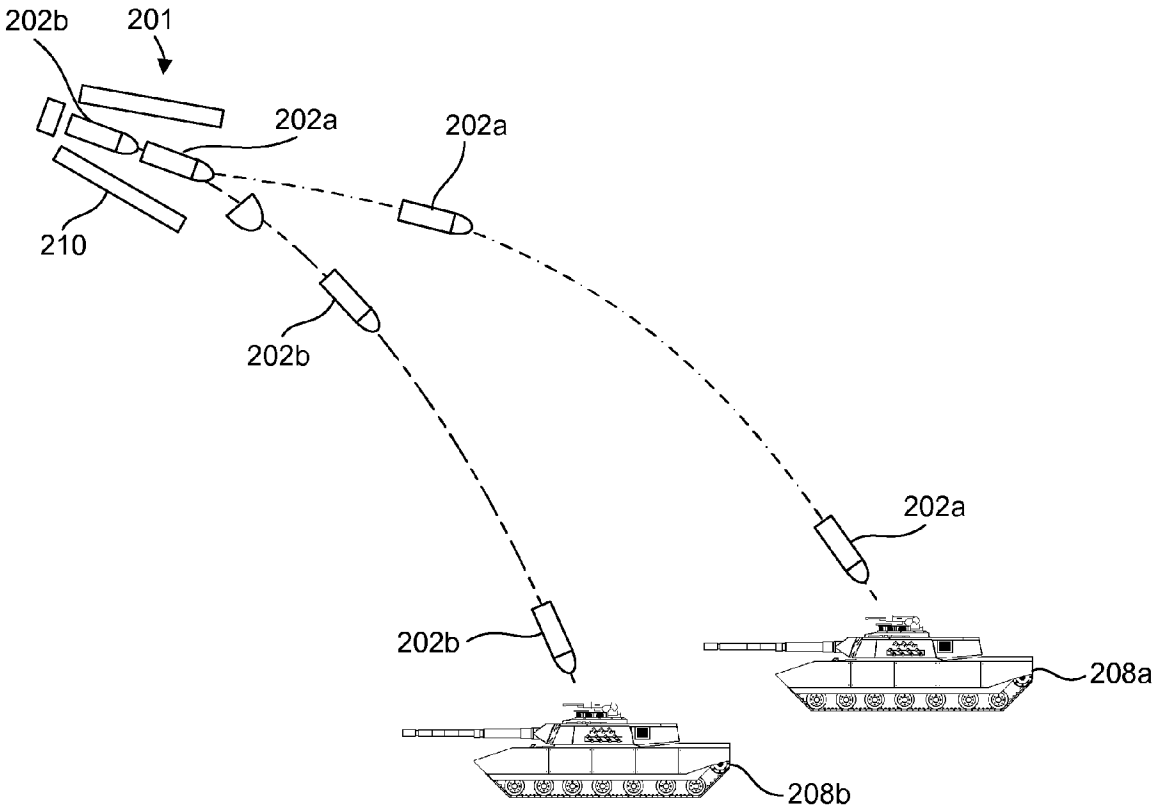
FIG. 2 is an example illustration of a ballistic sabot delivering multiple payloads, in accordance with an embodiment of the present invention.

FIG. 2 illustrates another embodiment of a ballistic sabot 201 in accordance with the present disclosure. In this case, a support structure 210 of the ballistic sabot 201 is configured to be releasably coupled to a plurality of payloads 202*a*, 202*b*. Carrying multiple payloads 202*a*, 202*b* can multiply the force available per launch. Thus, a single launch of the ballistic sabot 201 can be effective against multiple targets 208*a*, 208*b*. For example, payload 202*a* can be sent to target 208*a* and payload 202*b* can be sent to target 208*b*. The ballistic sabot 201 can therefore facilitate simultaneous engagement of multiple targets 208*a*, 208*b*, which may be stationary or moving targets. It should be recognized, however, that multiple payloads from a single ballistic sabot can be sent to a single target, if desired. In one aspect, the payloads 202*a*, 202*b* can be the same or different from one another, depending on the mission objectives. Flexibility in selecting payloads to launch with the ballistic sabot 201 can therefore provide mission flexibility with different payload and/or warheads, each having unique mission capabilities. The ballistic sabot 201 can therefore function as a capability expander and/or a force multiplier. In another aspect, the ballistic sabot can facilitate engaging, simultaneously or otherwise, one or more airborne targets, such as a UAV, one or more water borne targets, such as a boat, and/or land-based targets, such as a tank.

Figure 3A:
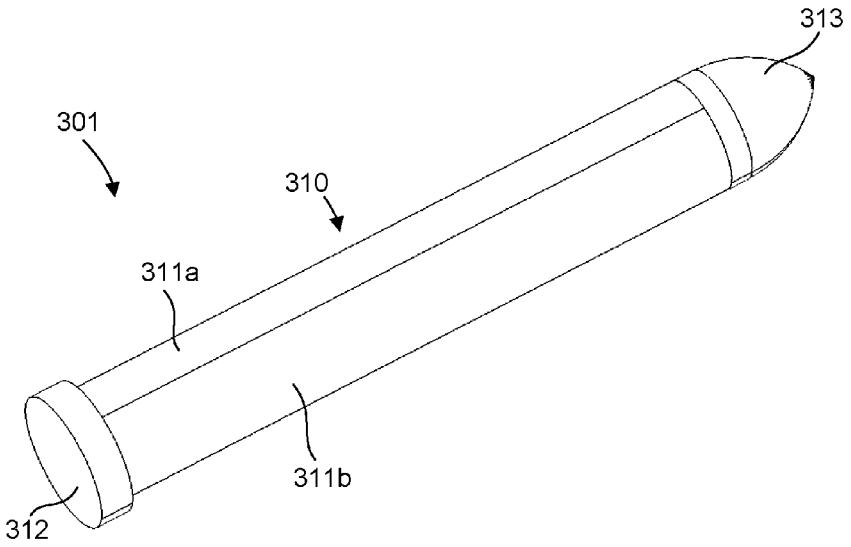
FIG. 3A is an example illustration of a ballistic sabot and payload in accordance with an embodiment of the present invention.
Figure 3B:
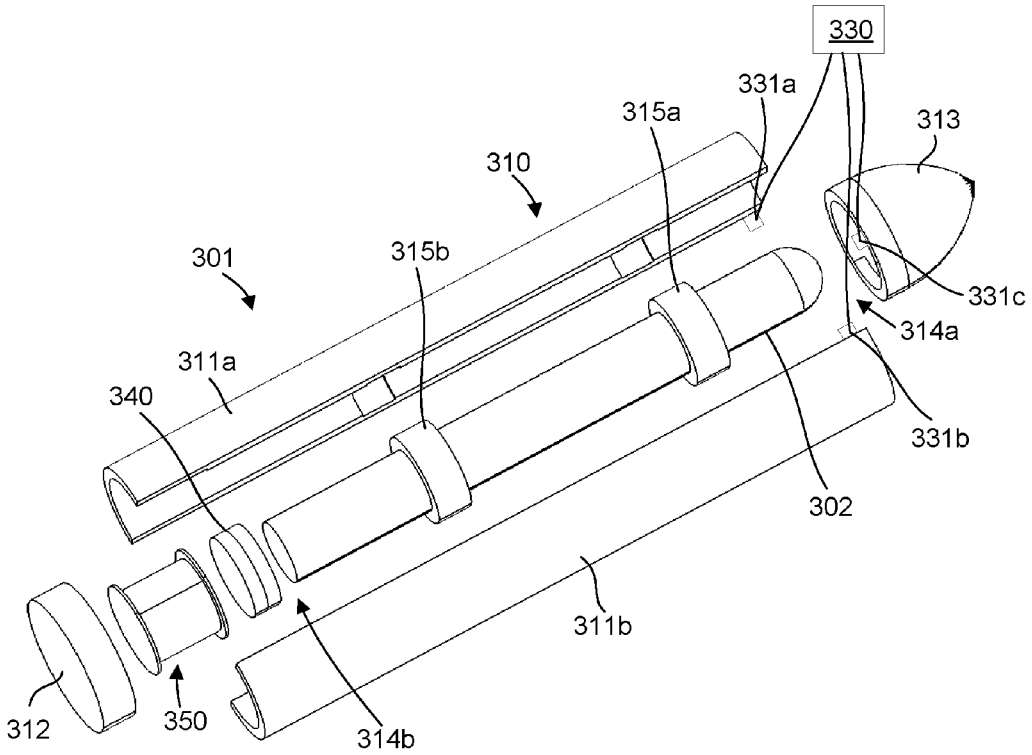
FIG. 3B is an exploded view of the ballistic sabot of FIG. 3A.

FIGS. 3A and 3B illustrate a ballistic sabot 301 in accordance with an example of the present disclosure. In one aspect, a support structure 310 of the ballistic sabot 301 can comprise an outer housing 311*a*, 311*b* disposed on lateral sides of a payload 302, an obturator 312 configured to interface with a bore of a launch device to create gas pressure behind the ballistic sabot 301, and/or a nose cone 313 over a forward end 314*a* of the payload 302. Thus, as shown in the figures, this configuration can be configured to physically encompass the payload 302 within the ballistic sabot 301, which can protect and shield the payload 302 during launch and can facilitate an aerodynamic shape of the ballistic sabot 301. One or more spacers 315*a*, 315*b* can be included between the payload 302 and the outer housing 311*a*, 311*b* to laterally support the outer housing 311*a*, 311*b* relative to the payload 302.

An electronic module 340 can be included at a rearward end 314*b* of the payload 302 and can be configured to physically and/or wirelessly couple with the payload 302 for data communication. The electronic module 340 can include an antenna, a power supply, a data coupling interface feature, or any other suitable system, device, or feature that may be desired as part of the electronic module 340.

The support structure 310 of the ballistic sabot 301, such as the outer housing 311*a*, 311*b*, the nose cone 313, and the obturator 312 can be releasably coupled to one another to maintain the sabot 301 intact until separation from the payload 302. For example, the outer housing 311*a*, 311*b* and the nose cone 313 can include releasable couplings 331*a*, 331*b*, 331*c*, respectively, to facilitate a coupling to one another and, when desired, release from one another. In some embodiments, a releasable coupling can comprise a latch, a fastener, a hook, a clip, a clasp, or any other suitable releasable coupling device or mechanism for support structure 310 components. The ballistic sabot 301 can also include a release mechanism 330 to initiate or cause release of the releasable couplings 331*a*, 331*b*, 331*c*. As mentioned above, the release mechanism 330 can comprise a "zero g" or gravity actuated release mechanism, that actuates or that is triggered when the vertical kinetic energy of the launch has been depleted. The release mechanism 330 can comprise electrical, mechanical, and/or electrical mechanical components. In one aspect, the release mechanism 330 can comprise a solenoid operable to release the releasable couplings 331*a*, 331*b*, 331*c*. In another aspect, the release mechanism can comprise a pyrotechnic charge to sever the releasable couplings 331*a*, 331*b*, 331*c*. Upon release of the releasable couplings 331*a*, 331*b*, 331*c*, aerodynamic forces and/or gravity can cause the support structure 310 components to fall apart or away from one another. In one aspect, a pyrotechnic charge can cause separation of the support structure 310 components.

In this embodiment, a launch force attenuation device 350 is located between the obturator 312 and the electronic module 340 at the rearward end 314*b* of the payload 302. In one aspect, the spacers 315*a*, 315*b* can also function as launch force attenuation devices. In another aspect, a launch force attenuation device can be located at the forward end 314*a* of the payload 302 proximate the nose cone 313. In general, a launch force attenuation device can comprise a hydraulic mechanism, a pneumatic mechanism, a magnetic mechanism, a spring, a crush plate, a screw, or combinations thereof to isolate the payload 302 from a launch device during launch and provide a controlled setback environment allowing a non or partially g-hardened payload to be successfully employed using a high-g launch device, such as a mortar.

Figure 4A:
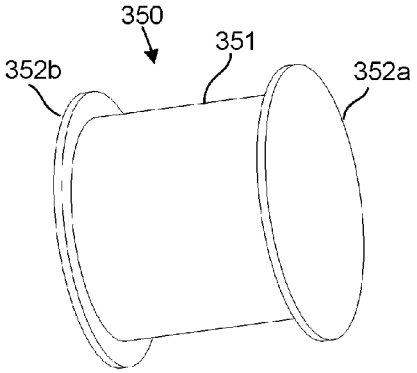
FIG. 4A is an example illustration of a launch force attenuation device of the ballistic sabot of FIGS. 3A and 3B, in accordance with an embodiment of the present invention.
Figure 4B:
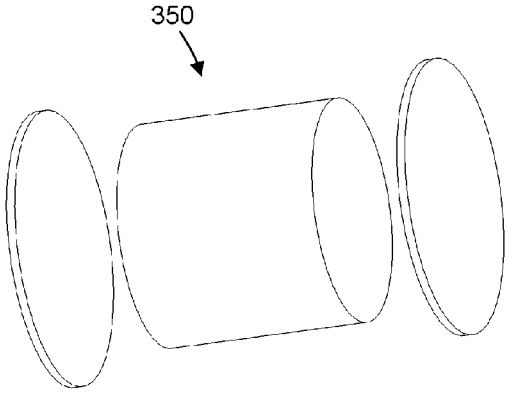
FIG. 4B is an exploded view of the launch force attenuation device of FIG. 4A.

FIGS. 4A and 4B illustrate the launch force attenuation device 350 of ballistic sabot 301. In this embodiment, the launch force attenuation device 350 comprises a spring 351. The spring 351 can comprise an elastomer, a metal, a composite, a polymer, or any other suitable material for a spring 351. The spring 351 can also comprise any suitable size or shape configuration, such as a cylinder or a coil. The spring 351 can be disposed between supports plates 352*a*, 352*b* to separate the spring from adjacent components within the ballistic sabot 301.

Figure 5A:
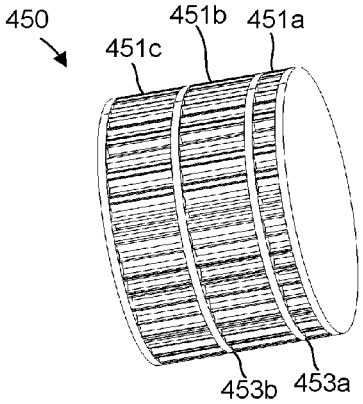
FIG. 5A is an example illustration of a launch force attenuation device in accordance with another embodiment of the present invention.
Figure 5B:
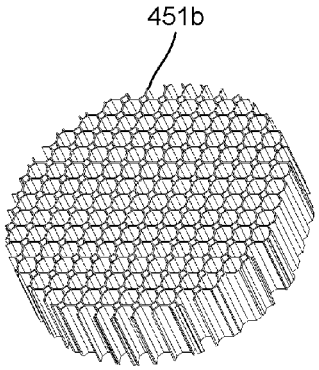
FIGS. 5B and 5C are example illustrations of crush plates of the launch force attenuation device of FIG. 5A.
Figure 5C:
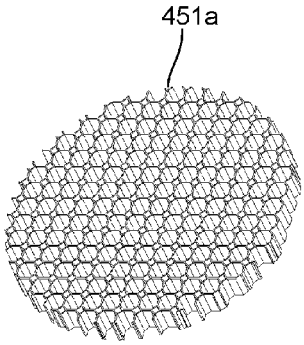

FIGS. 5A-5C illustrate another embodiment of a launch force attenuation device 450 in accordance with the present disclosure. In this embodiment, the launch force attenuation device 450 comprises one or more crush plates 451*a*, 451*b*, 451*c*, which can be separated by one or more dividers 453*a*, 453*b*. The crush plates 451*a*, 451*b*, 451*c* can be configured to crush or collapse at a specific g-load. Thus, the crush plates 451*a*, 451*b*, 451*c* can be stacked or arranged to provide a desired response upon launch. In one aspect shown in FIGS. 5B and 5C, though not intending to be limiting in any way, the crush plates 451*a*, 451*b* can comprise a honeycomb configuration and can be of any suitable thickness to provide a desired response to g-loading.

Figure 6:
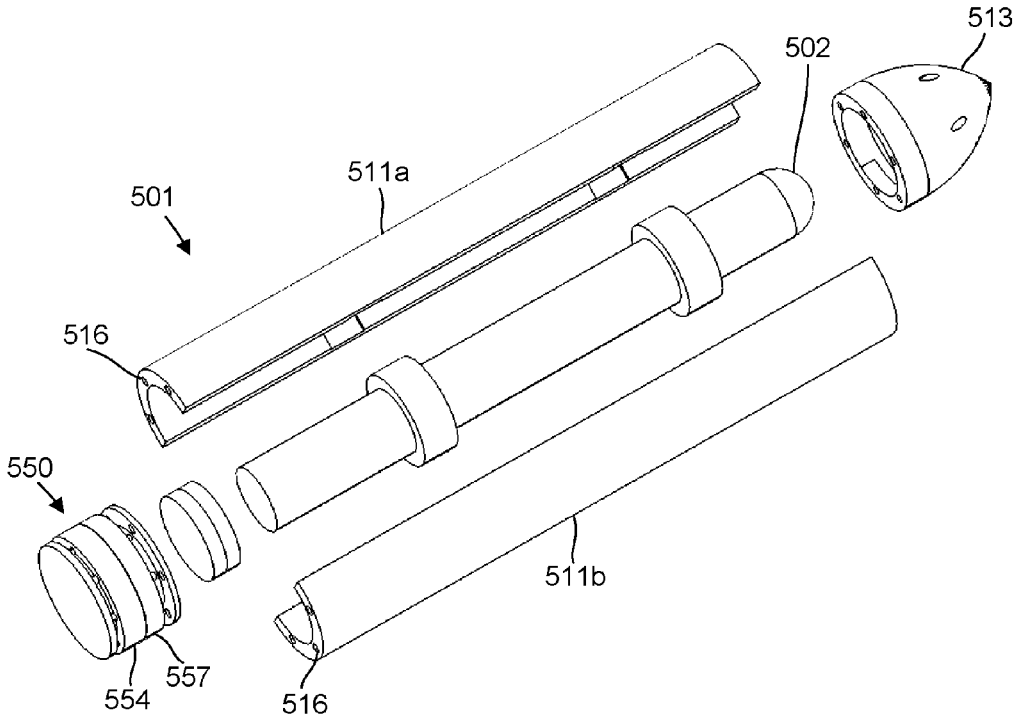
FIG. 6 is an example illustration of a ballistic sabot and payload in accordance with another embodiment of the present invention.
Figure 7A:
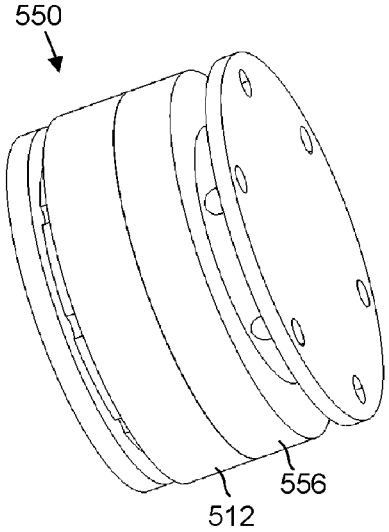
FIG. 7A is an example illustration of a launch force attenuation device of the ballistic sabot of FIG. 6, in accordance with yet another embodiment of the present invention.
Figure 7B:
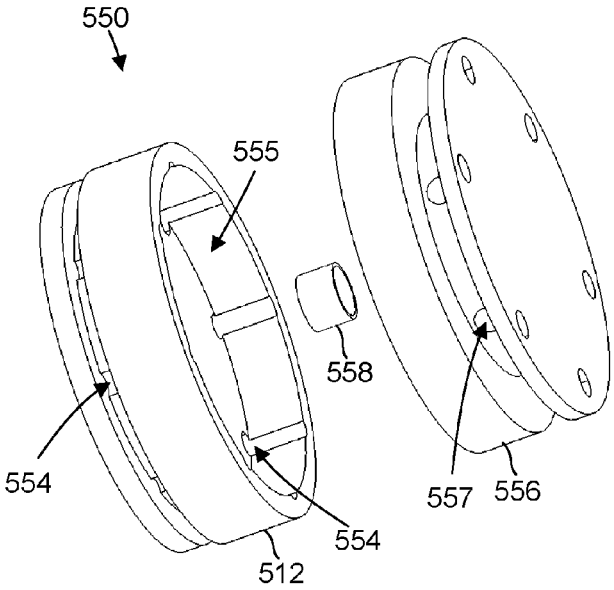
FIG. 7B is an exploded view of the launch force attenuation device of FIG. 7A.
Figure 8:
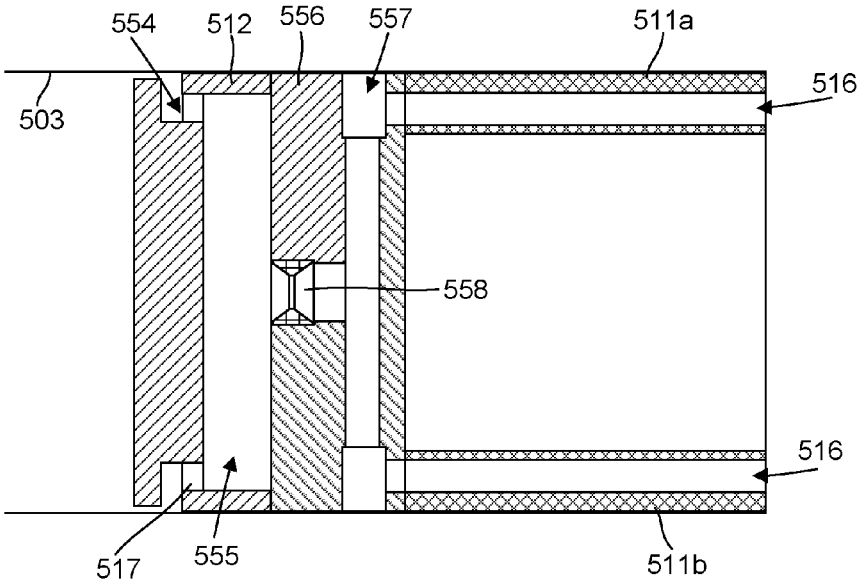
FIG. 8 is a schematic view of the launch force attenuation device of FIGS. 7A and 7B.
Figure 9:
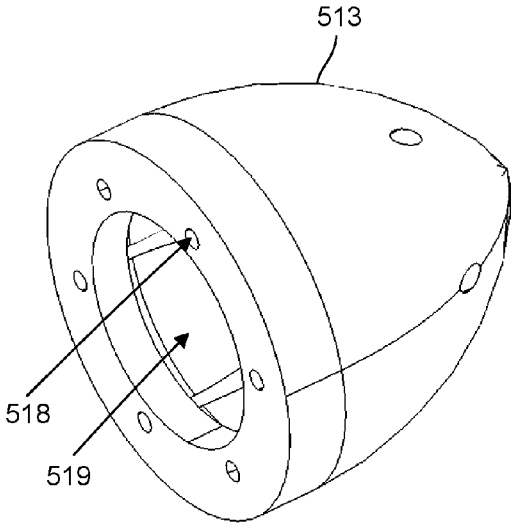
FIG. 9 is an example illustration of a nose cone of the ballistic sabot of FIG. 6, in accordance with an embodiment of the present invention.

FIG. 6 illustrates a ballistic sabot 501 in accordance with another example of the present disclosure. In this embodiment, a launch force attenuation device 550 can comprise a gas bypass system that integrates an obturator. As shown in more detail in FIGS. 7A-9, and with continued reference to FIG. 6, the launch force attenuation device 550 can include an obturator 512 with one or more openings 554 to facilitate passage of gas there through to a chamber 555. The chamber 555 can be in fluid communication with a manifold 556 that can include one or more conduits 557 operable to direct gas to one or more conduits 516 in outer housings 511*a*, 511*b*. A nozzle 558 can be included to regulate the flow of gas into the manifold 556. Thus, the launch force attenuation device 550 can direct some gas around the obturator 512 through the openings 554, into the chamber 555, through the nozzle 558, into the conduits 557 of the manifold 556, and to the conduits 516 of the outer housings 511*a*, 511*b*. In one aspect, a burst disk 517 can be associated with the openings 554 and configured to rupture at a predetermined pressure to facilitate symmetrical distribution of the gas around the obturator 512 in order to minimize balloting, or side to side motion, of the ballistic sabot 501 and the payload 502 in a launch device 503. The conduits 516 of the outer housings 511*a*, 511*b* can direct the gas to openings 518 in the nose cone 513, where the gas can be vented to an interior 519 of the nose cone 513 or to atmosphere outside the nose cone 513.

Figure 10A:
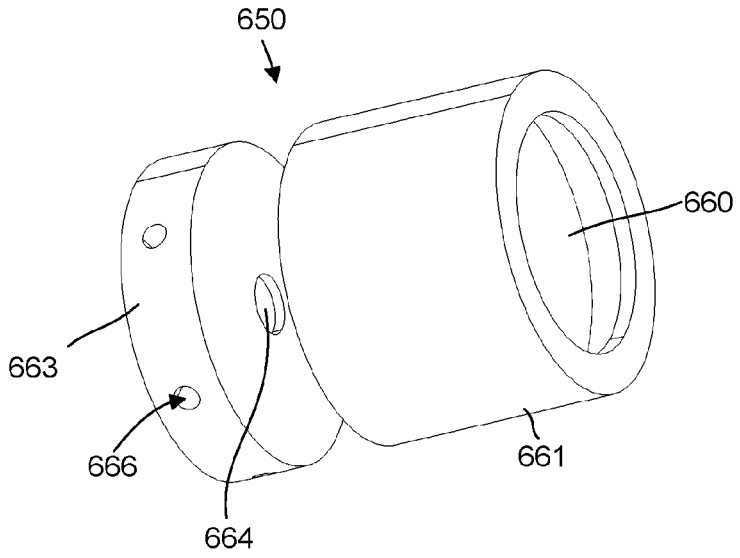
FIGS. 10A and 10B are example illustrations of a launch force attenuation device in accordance with still another embodiment of the present invention.
Figure 10B:
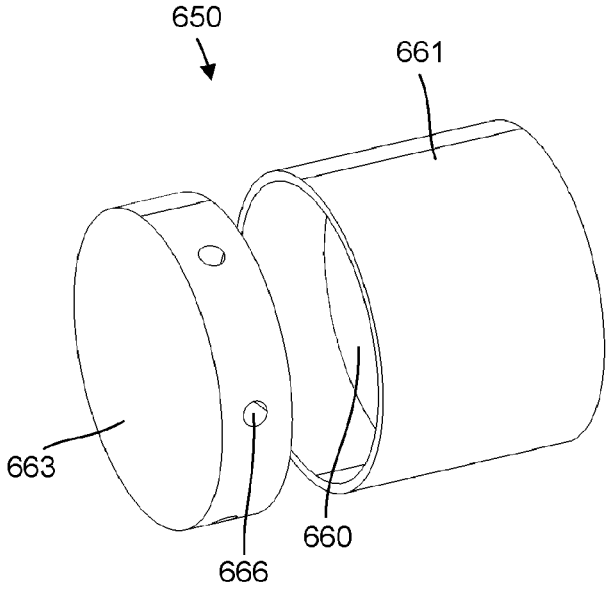
Figure 11:
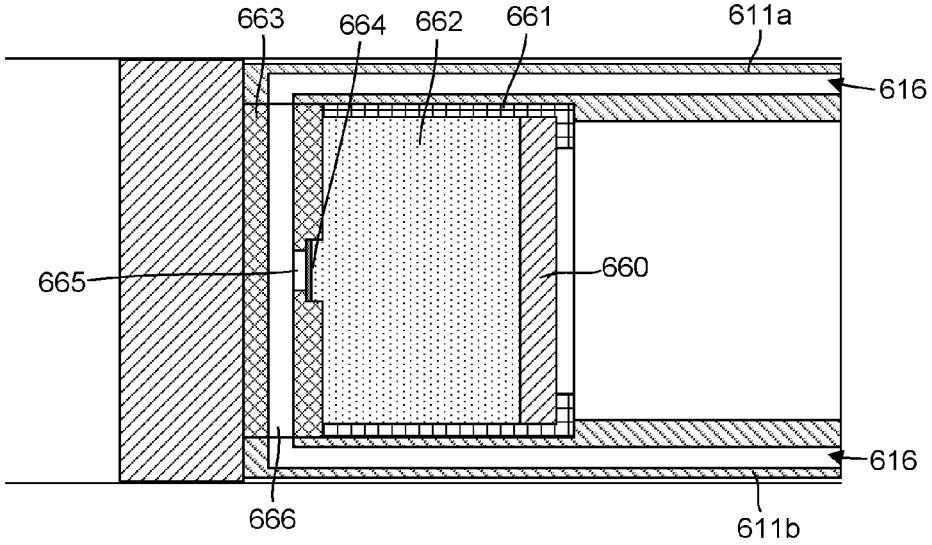
FIG. 11 is a schematic view of the launch force attenuation device of FIGS. 10A and 10B.
Figure 12:
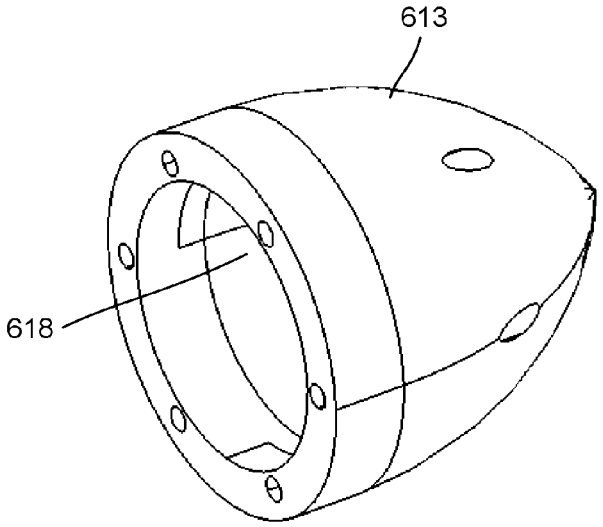
FIG. 12 is an example illustration of a nose cone of a ballistic sabot, in accordance with another embodiment of the present invention.

FIGS. 10A-11 illustrate another embodiment of a launch force attenuation device 650 in accordance with the present disclosure. In this embodiment, the launch force attenuation device 650 comprises a pneumatic or a hydraulic piston mechanism to dampen g-loading on a payload upon launch. For example, the launch force attenuation device 650 can include a piston 660 disposed in a cylinder 661 filled with a gas or fluid 662, which is initially maintained in the cylinder 661 by a base 663 with a burst disk 664 configured to rupture at a predetermined pressure. At launch, a payload or other internal component, such as an electronic module, can be forced against the piston 660, which can cause an increase in pressure within the cylinder 661 until the burst disk 664 ruptures, allowing the gas or fluid 662 to escape the cylinder through an orifice 665. In one aspect, the rate of movement of the piston 660 can be controlled by a diameter of the orifice 665. The gas or fluid 662 can pass through one or more conduits 666 in the base 663 to one or more conduits 616 in outer housings 611*a*, 611*b*. The conduits 616 of the outer housings 611*a*, 611*b* can direct the gas or fluid 662 to openings 618 in the nose cone 613, where the gas or fluid 662 can be vented to atmosphere outside the nose cone 613, as shown in FIG. 12.

It should be recognized that the principles of the various launch force attenuation devices disclosed herein can be utilized alone or in any combination to achieve a desired result. In addition, a launch force attenuation device can be incorporated or disposed anywhere relative to a payload to achieve a desired result.

Figure 13:
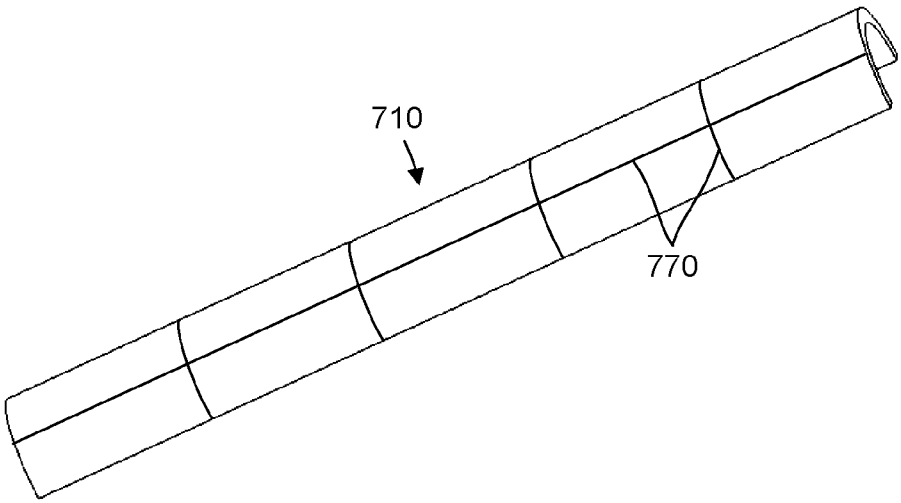
FIG. 13 is an example illustration of a support structure of a ballistic sabot, in accordance with an embodiment of the present invention.

FIG. 13 illustrates a support structure 710 of a ballistic sabot, in accordance with an example of the present disclosure. This example illustrates that the support structure can be etched 770 to facilitate disintegration into smaller pieces upon separation from the payload. This can reduce a potential for damage from the structural support upon impact. Although an outer housing is shown, it should be recognized that any structural support can be etched to achieve the desired result.

Figure 14:
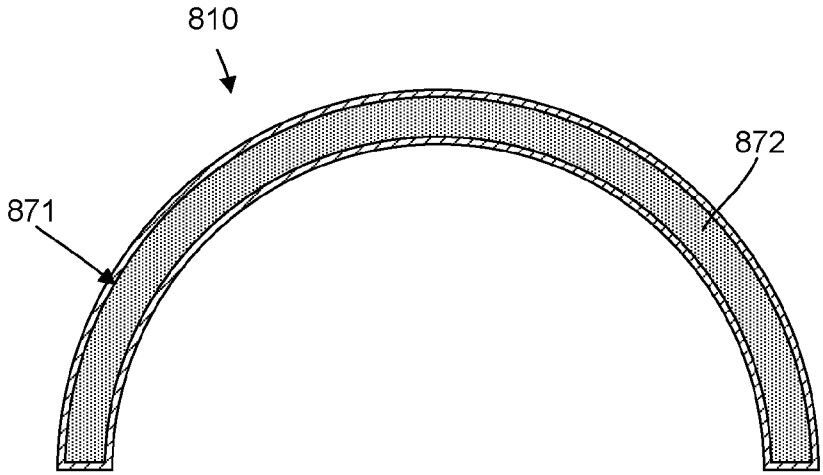
FIG. 14 is a cross-sectional view of a support structure of a ballistic sabot, in accordance with another embodiment of the present invention.

FIG. 14 illustrates a support structure 810 of a ballistic sabot, in accordance with another example of the present disclosure. This example illustrates that the support structure 810 can comprise a void or opening 871 that can be filled with a fill material 872. In one aspect, the fill material can reduce the potential for damage upon impact by the structural support 810 discarded downrange by dispersing over a large area upon separation of the support structure 810 from a payload. The fill material 872 can comprise sand, aluminum shavings, steel shavings, talc, chalk, charcoal, cork, or combinations thereof. In some embodiments, the payload can be physically segregated from the fill material 872 by a membrane or container. In another aspect, the fill material 872 can facilitate attenuation of vibrational energy transferred to a payload within a ballistic sabot while retaining sufficient mass for the desired ballistic attributes. For example, the fill material can dissipate a portion of the energy transferred to the payload during the in-bore travel in a launch device as a result of balloting within the bore. The less dense fill material medium can serve as an inefficient transfer mechanism between the balloting energy and the payload. Although an outer housing is shown, it should be recognized that any structural support can be filled with a fill material to achieve the desired result.

Figure 15:
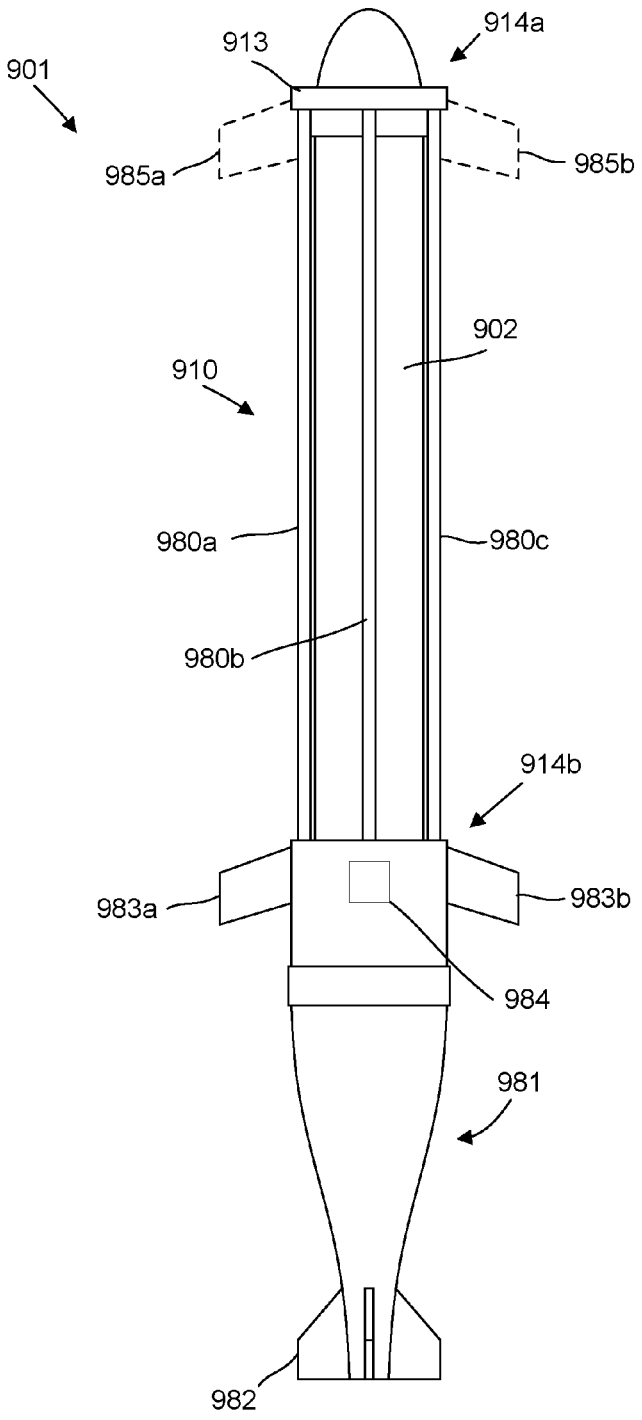
FIG. 15 is an example illustration of a ballistic sabot and payload in accordance with yet another embodiment of the present invention.

FIG. 15 illustrates a ballistic sabot 901 and a payload 902 in accordance with another example of the present disclosure. In this embodiment, a support structure 910 can comprise a cage configuration in place of an outer housing and a nose ring 913 in place of a nose cone, as disclosed hereinabove. The cage configuration can include ribs or spines 980*a*, 980*b*, 980*c* disposed longitudinally about lateral sides of the payload 902. The ribs 980*a*, 980*b*, 980*c* can be captured at a forward end 914*a* of the payload 902 by the nose ring 913 such that the nose cone or forward structure of the payload is exposed. It should be recognized that a nose cone of the support structure can capture the ribs 980*a*, 980*b*, 980*c* and cover the forward structure of the payload 902, as described hereinabove. Also shown is an aerodynamic tail 981, which can include one or more fins 982 disposed at a rearward end 914*b* of the payload 902.

In one aspect, the ballistic sabot 901 can include a control surface 983*a*, 983*b*, such as a wing or fin, supported by the support structure 910 to facilitate control of the ballistic sabot 901 and payload 902 following launch. This can provide in-flight stability and/or course correction for the ballistic sabot 901 and the payload 902 prior to separation. The control surface 983*a*, 983*b* can be deployable upon leaving the launch device. In one aspect, the control surface 983*a*, 983*b* can be actuatable. In this case, an actuator 984 operable to move the control surface 983*a*, 983*b* can be and controlled by an electronic module, as discussed hereinabove. In another aspect, a control surface 985*a*, 985*b* can be disposed at the forward end 914*a* to provide increased maneuverability and accuracy in payload delivery.

In one aspect, the ballistic sabot 901 can facilitate a flatter angle of attack than would otherwise be possible. For example, the ballistic sabot 901 can manipulate the control surfaces 983*a*, 983*b* such that pitch and yaw of the ballistic sabot 901 are adjusted to position the payload 902 in a desired orientation in space and time. This can have the effect of subtending the ballistic portion of the flight after apogee and aiming the payload 902 at particular point in space orthogonal to the ground, whereas the original post-apogee ballistic portion of the flight would have the payload 902 aimed at a point parallel to the ground. Thus, if a 120 mortar system fired a typical unguided ballistic projectile in an attempt to eliminate a sniper in a multi-story building, the unaltered, post-apogee, ballistic portion of the flight would have the projectile impacting the roof of the building (the roof is considered parallel to the ground). That is one reason why mortars are not typically used for this type of fire support mission. However, when using a mortar system firing the ballistic sabot 901 and the payload 902 in an attempt to eliminate a sniper at a window in a multi-story building, the subtended, post-apogee portion of the flight can have the projectile aimed at the particular window (considered orthogonal to the ground) when the payload 902 rocket motor fires.

In another aspect, releasing the payload 902 at or near apogee can significantly extend the range of the deployed payload 902. For example, after release, the payload 902 can utilize the control surfaces 983*a*, 983*b* to generate aerodynamic lift permitting the payload 902 to glide, thereby greatly extending the downrange component of its resultant velocity vector. This gliding method can greatly extend the range over common ballistic projectiles, which under direct influence of gravity have a much shorter downrange, velocity vector component.

Figures 16A, 16B, 16C:
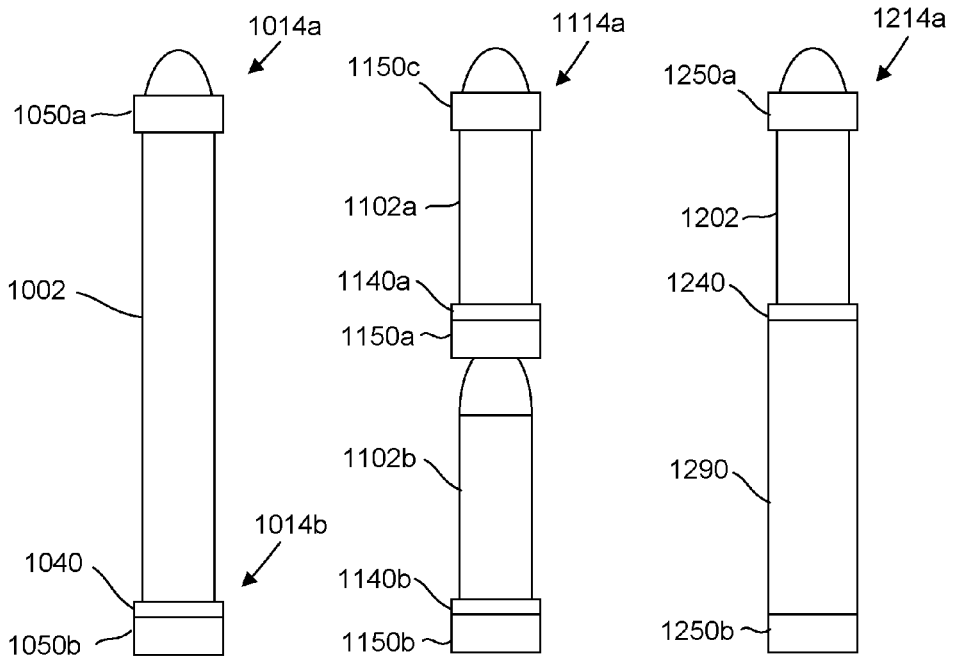
FIGS. 16A-16C are example illustrations of payload configurations in accordance with several embodiments of the present invention.

FIGS. 16A-16C illustrate payload configurations in accordance with several examples of the present disclosure. Ballistic sabot support structures have been omitted for clarity. As shown in FIG. 16A, a single large payload 1002 can be contained within a ballistic sabot, with an electronic module 1040 disposed behind the payload 1002. Launch force attenuation devices 1050*a*, 1050*b* can be located at forward 1014*a* and rearward 1014*b* ends of the payload 1002, respectively. FIG. 16B illustrates that two smaller payloads 1102*a*, 1102*b* can be contained within a ballistic sabot, with electronic modules 1140*a*, 1140*b* and launch force attenuation devices 1150*a*, 1150*b* disposed behind the payloads 1102*a*, 1102*b*, respectively. A launch force attenuation device 1150*c* can be disposed at a forward end 1114*a* of the payload 1102*a*. FIG. 16C illustrates that a single small payload 1202 can be contained within a ballistic sabot, with a spacer 1290 in place of another payload. Here, a launch force attenuation device 1250*a* can be disposed at a forward end 1214*a* of the payload 1202 and a launch force attenuation device 1250*b* can be disposed behind the spacer 1290. It should be recognized, however, that the launch force attenuation device 1250*b* can be disposed in front of the spacer 1290. An electronic module 1240 can be disposed behind the payload 1202 and in front of the spacer 1290 (as shown) or behind the spacer 1290. Thus, a ballistic sabot as disclosed herein can accommodate different types and sizes of sub-caliber payloads. In one aspect, a ballistic sabot and payload unit can be provided pre-assembled or at the component level and subsequently assembled at the launch site.

In accordance with one embodiment of the present invention, a method of facilitating delivery of a payload is disclosed. The method can comprise providing a ballistic sabot for adapting a payload to a launch device, the ballistic sabot having a support structure configured to be releasably coupled to the payload and to operably interface with the launch device, wherein the launch device is operable to launch the payload and the support structure on a ballistic trajectory. The method can further comprise facilitating retention of the payload by the ballistic sabot such that the ballistic sabot travels with the payload along the ballistic trajectory substantially beyond the launch device. Additionally, the method can comprise facilitating release and separation of the ballistic sabot from the payload. It is noted that no specific order is required in this method, though generally in one embodiment, these method steps can be carried out sequentially.

In one aspect, the method can further comprise facilitating communication between the ballistic sabot and the payload. In a particular aspect, the method can further comprise facilitating communication between the ballistic sabot and a command station. In another aspect, the method can further comprise facilitating attenuation of launch force by the ballistic sabot to protect the payload from damage.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A ballistic sabot for adapting a payload to a launch device, comprising:

a support structure releasably coupleable to a payload and configured to operably interface with a launch device, the launch device being operable to launch the payload and the ballistic sabot on a ballistic trajectory;

a launch force attenuation device about the support structure configured to absorb launch forces to protect the payload from damage; and a release mechanism that is selectively actuatable to facilitate release and separation of the support structure and the payload from one another, wherein the support structure retains and travels with the payload along the ballistic trajectory substantially beyond the launch device prior to selective actuation of the release mechanism to release and separate the support structure from the payload.

2. The ballistic sabot of claim 1, wherein the release mechanism is selectively actuatable, such that the support structure retains and travels with the payload to an apogee of the ballistic trajectory prior to release and separation from the payload.

3. The ballistic sabot of claim 1, wherein the release mechanism is selectively actuatable, such that the support structure retains and travels with the payload beyond an apogee of the ballistic trajectory prior to release and separation from the payload.

4. The ballistic sabot of claim 1, further comprising an electronic module configured to communicate with the payload.

5. The ballistic sabot of claim 4, wherein the electronic module is configured to communicate with a command station separate from the ballistic sabot and payload.

6. The ballistic sabot of claim 5, wherein the electronic module is configured to relay communication between the command station and the payload.

7. The ballistic sabot of claim 1, wherein the launch force attenuation device comprises a hydraulic mechanism, a pneumatic mechanism, a magnetic mechanism, a gas bypass system, a spring, a crush plate, a screw, or combinations thereof.

8. The ballistic sabot of claim 1, wherein the support structure comprises an obturator configured to interface with a bore of the launch device.

9. The ballistic sabot of claim 1, wherein the support structure comprises an outer housing.

10. The ballistic sabot of claim 1, wherein the support structure comprises a nose cone.

11. The ballistic sabot of claim 1, wherein the support structure encompasses the payload.

12. The ballistic sabot of claim 1, wherein the support structure is etched to facilitate disintegration into smaller pieces upon separation from the payload.

13. The ballistic sabot of claim 1, wherein the payload comprises a plurality of payloads and the support structure is configured to be releasably coupled to the plurality of payloads.

14. The ballistic sabot of claim 1, further comprising an actuatable control surface supported by the support structure to facilitate control of the ballistic sabot and payload following launch.

15. The ballistic sabot of claim 1, wherein the structural support comprises a void Tillable by a fill material, wherein the fill material is dispersible upon separation of the support structure from the payload to reduce a potential for damage from the structural support upon impact.

16. The ballistic sabot of claim 15, wherein the fill material comprises sand, aluminum shavings, steel shavings, talc, chalk, charcoal, cork, or combinations thereof.

* * * * *